US005560522A

United States Patent [19]

Clark

[11] Patent Number: 5,560,522

[45] Date of Patent: Oct. 1, 1996

[54] PUSH OPENED VALVE FOR DISPENSING LIQUIDS

[76] Inventor: Robert D. Clark, 3911 Timberidge Dr., Norman, Okla. 73072

[21] Appl. No.: 429,268

[22] Filed: Apr. 25, 1995

[51] Int. Cl.[6] ..... B65D 5/72

[52] U.S. Cl. ..... 222/481.5; 222/518; 222/529; 141/335; 141/353

[58] Field of Search ..... 222/529, 439, 222/481.5, 484; 141/309, 335, 353, 348, 391, 198, 39

[56] References Cited

U.S. PATENT DOCUMENTS

| | | | |
|---|---|---|---|
| 1,912,022 | 5/1933 | Thompson | 222/496 |
| 2,701,078 | 2/1955 | Bowman | 222/529 |
| 3,074,444 | 1/1963 | Hawksford | 141/353 X |
| 3,180,539 | 4/1965 | Petronello | 222/514 |
| 4,884,600 | 12/1989 | Wilson | 141/335 X |
| 5,090,600 | 2/1992 | Clark | 222/492 |
| 5,107,909 | 4/1992 | Donovan | 222/484 X |
| 5,249,611 | 10/1993 | Law | 141/335 X |

*Primary Examiner*—Gregory L. Huson
*Attorney, Agent, or Firm*—Robert K. Rhea

[57] ABSTRACT

A fluid dispensing valve for a liquid container having a pouring spout is formed by an inner sleeve axially connected to the spout of a liquid container. The other end of the inner sleeve is closed and provided with wall outlet ports. An outer sleeve slidably surrounds the closed end portion of the inner sleeve for covering and uncovering the inner sleeve wall ports. The outwardly flared end of a funnel-type tube secured to the periphery of the outer sleeve projects beyond the closed end of the inner sleeve for entering a port of a receiving vessel at its other end portion. The valve is opened by axial force applied to the inner sleeve opposite its closed end which moves relative to the outer sleeve and uncovers the wall ports. Releasing the axial pressure on the inner sleeve allows a spring interposed between a shoulder or the inner sleeve and adjacent end of the outer sleeve to bias the latter toward and cover the inner sleeve ports.

9 Claims, 3 Drawing Sheets

PUSH OPENED VALVE FOR DISPENSING LIQUIDS

BACKGROUND OF THE INVENTION

1. Field of The Invention

This invention relates to a novel valve for dispensing liquids from portable liquid containers, either rigid or with flexible plastic walls, and more particularly to those containers equipped with extension tubes or pouring spouts.

There are many circumstances when an extension such as an attached spout or tube is either necessary or desired to avoid spilling when pouring liquids from a portable container into another container, a vehicle engine, or the like. When adding motor oil to an automobile engine, filling or adding fluid to an automatic transmission or pouring liquid from a hand held container to a remote location, such as the automatic transmission filler tube at the rear of an engine, is difficult to accomplish without spilled oil or fluid. There is a need for a valve on the delivering end of a spout or long tube which can be remotely opened by manually forcing an end of the valve against an inlet port and close when such force is released.

2. Description of the Prior Art

U.S. Pat. No. 5,090,600 issued Feb. 5, 1992 to Clark for LIQUID PRESSURE OPENED POURING SPOUT discloses inner and outer sleeves forming a pouring spout in which the outer sleeve is fixed to the inner wall surface of a container pouring neck or spout and the inner sleeve is provided with normally closed ports when the inner sleeve is fully contained by the outer sleeve. The inner sleeve is moved to open position by liquid pressure against the closed end of the inner sleeve biasing its ports beyond the outer sleeve by fluid pressure generated by squeezing the walls of the container being emptied.

U.S. Pat. No. 1,912,022 issued May 30, 1933 to Thompson for DISPENSING CLOSURE FOR COLLAPSIBLE CONTAINERS and U.S. Pat. No. 3,180,539 issued Apr. 27, 1965 to Petronello for FLUID DISPENSING ARRANGEMENT are believed to show the further state-of-the-art.

This invention is distinctive over each of the above named patents by providing a manual pressure opened spring closed sleeve valve arrangement for dispensing liquid in which an inner tube having wall outlet ports is surrounded by an outer sleeve longitudinally slidable on the inner sleeve. Manual pressure applied axially to the inner tube moves the outer sleeve to open the inner sleeve ports.

SUMMARY OF THE INVENTION

A dust proof spill free liquid dispensing valve is formed by an inner sleeve having one closed end and wall ports adjacent its closed end with its other end adapted to be connected with the dispensing opening of a liquid container and an outer sleeve slidably surrounding the inner sleeve outer end portion between an annular shoulder on the inner sleeve and its closed end. The inner peripheral surface of the outer sleeve adjacent its end opposite the annular shoulder normally seats an annular rib forming a sleeve stop on the closed end of the inner sleeve to maintain the inner sleeve ports closed.

A funnel-like dispensing tube surrounds, at its larger end portion, that end portion of the outer sleeve opposite the inner sleeve annular shoulder for directing fluid dispensed from a container into an inlet port of a receiving vessel. The valve is opened by manual pressure applied axially to the inner sleeve, as by moving an inverted container downwardly against the dispensing tube when inserted into the receiving port of a vessel, moving the outer sleeve to an inner sleeve dispensing port opened position. The outer sleeve is biased to inner sleeve port closed position, when manual pressure on the inner sleeve is released, by a spring interposed between the inner sleeve annular shoulder and adjacent end of the outer sleeve.

The inner sleeve is further provided with a container aerating tube open at one end to the atmosphere through a ball check valve in a wall opening of the inner sleeve and projecting at its other end portion a substantial distance into a container being emptied adjacent one wall thereof for admitting atmospheric air into the container to replace fluid leaving the container with atmospheric air and increasing the rate of fluid flow from the container.

The principal object of this invention is to provide a non-spilling normally closed liquid dispensing valve for a container which is opened by manual pressure applied axially to the container impinging the dispensing valve against the inlet opening of a receiving vessel and in which the valve is spring biased closed when the manual pressure against the container is released.

DESCRIPTION OF THE PREFERRED EMBODIMENTS

Like characters of reference designate like parts in those figures of the drawings in which they occur.

Figure 1:
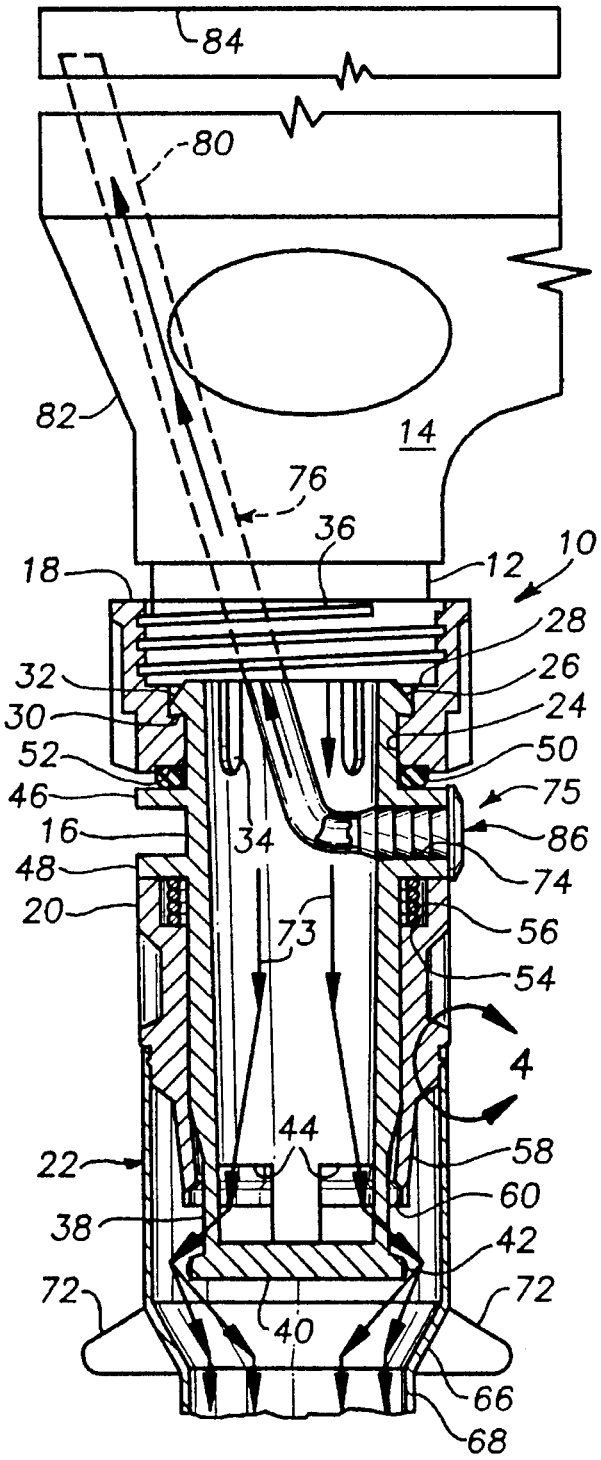
FIG. 1 is a fragmentary vertical cross sectional view of the valve in open position when connected with the outlet spout of a fluid container.
Figure 2:
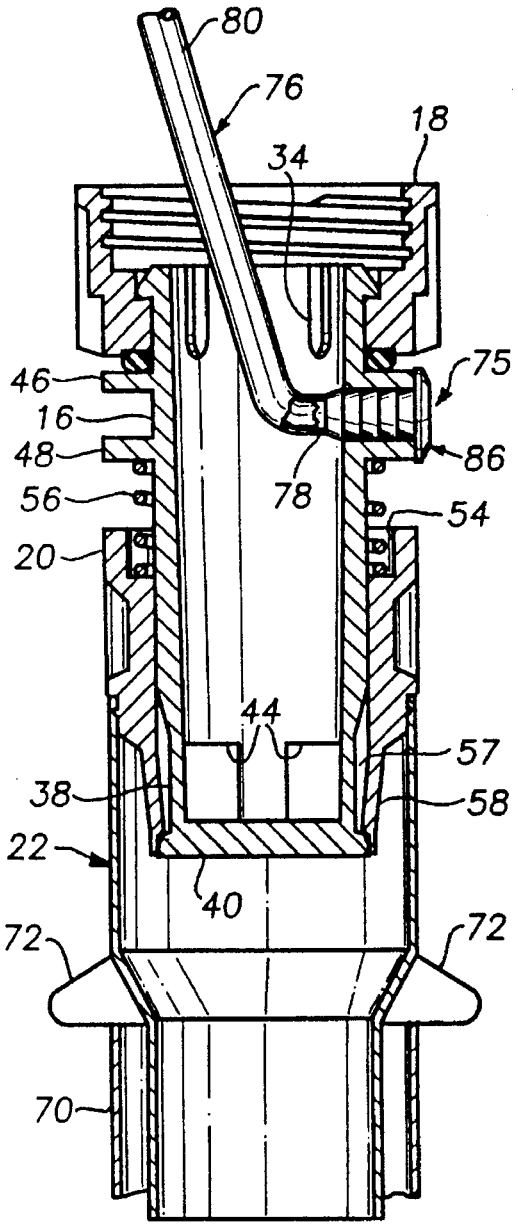
FIG. 2 is a vertical cross sectional view, similar to FIG. 1, illustrating the valve, per se, in closed position.
Figure 6:
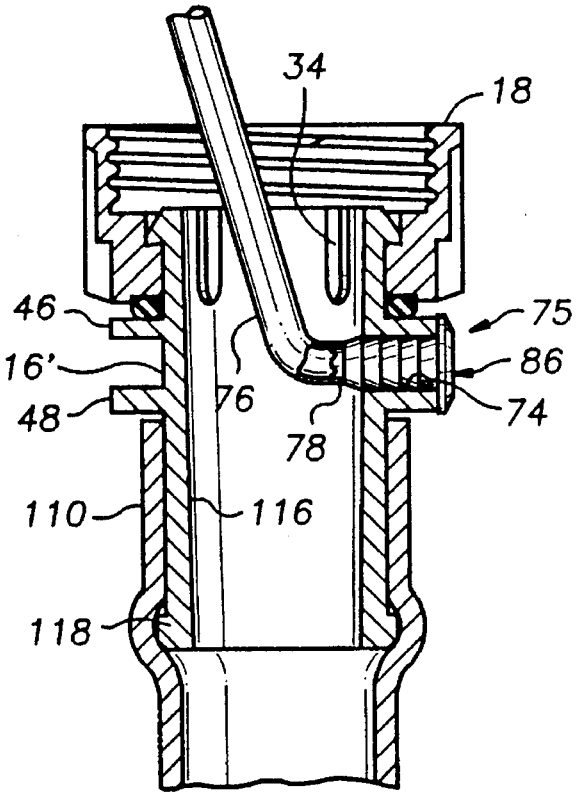
FIG. 6 is a fragmentary vertical cross sectional view taken substantially along the line 6—6 of FIG. 5 and rotated 90° counterclockwise.
Figure 7:
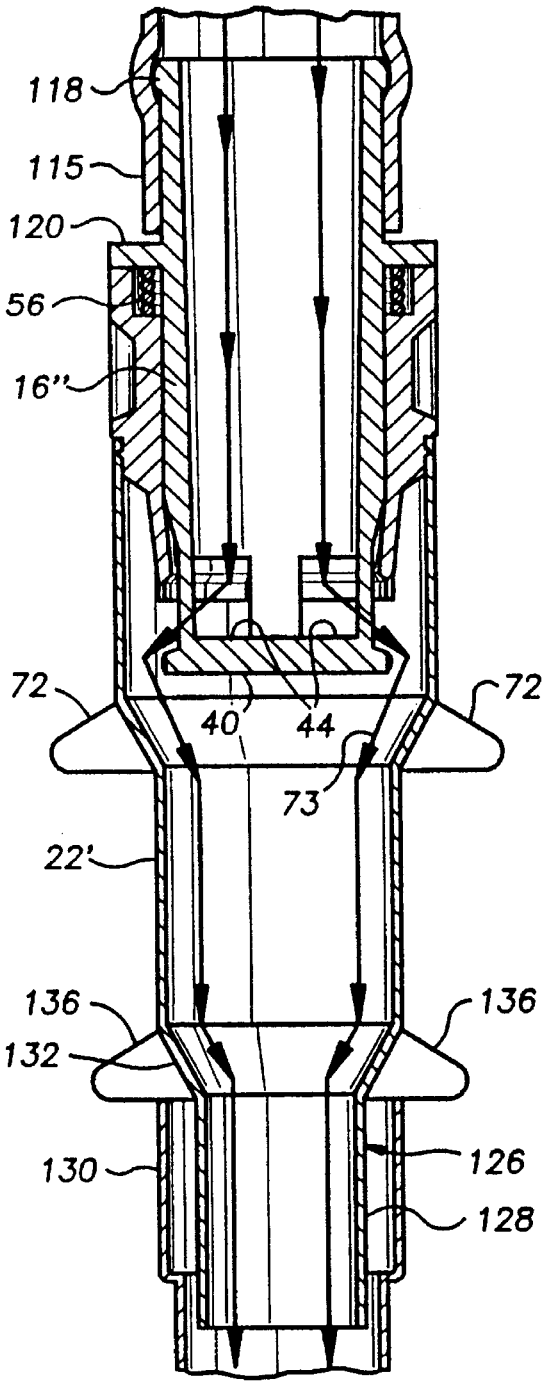
FIG. 7 is a fragmentary vertical cross sectional view taken substantially along the line 7—7 of FIG. 5.
Figure 3:
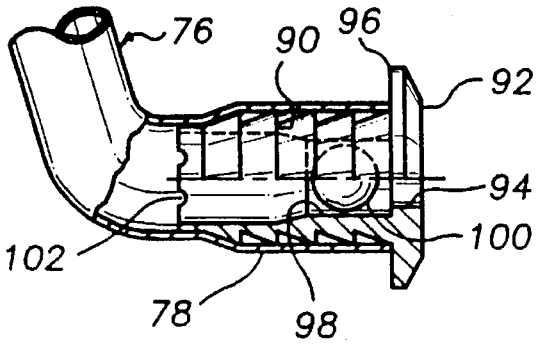
FIG. 3 is a fragmentary vertical cross sectional view, partially in elevation, to an enlarged scale.

Referring first to FIGS. 1 and 2, the reference numeral 10 indicates the valve as a whole when connected with the port forming spout or neck 12 of a fluid container 14. The valve 10 includes an inner sleeve 16 having a coupling 18 at one end for connecting the valve to the container 14. The valve further includes and outer sleeve 20 slidably surrounding the inner sleeve end portion opposite the coupling 18 and connected at its end portion opposite the coupling, to one end portion of a fluid discharge tube 22.

The central bore 24 of the coupling 18 rotatably surrounds the adjacent end portion of the wall of the sleeve 16 and the coupling end portion opposite the sleeve 16 is step diameter counterbored to form upwardly facing annular shoulders 26 and 28 as viewed in the drawings. The shoulder 26 abuts an annular outstanding shoulder 30 on the adjacent end portion of the sleeve 16. The outer peripheral end edge surface of the sleeve 6 is chamfered, as at 32, and the adjacent end portion of the sleeve 16 is provided with a plurality of circumferentially spaced longitudinal slots 34 to facilitate inward bending of the sleeve sections between the slots when the sleeve is inserted into the coupling bore 24. The inner wall surface of the counterbore forming the shoulder 28 is threaded for cooperatively receiving threads 36 on the container neck 12.

The outer peripheral end portion of the inner sleeve 16, opposite the coupling, is diametrically reduced, as at 38 and closed by a disc-like cap 40 having an annular substantially semicircular outstanding rib 42 forming an outer sleeve stop for the purposes presently explained.

Adjacent its closed end 40, the inner sleeve is provided with a plurality of circumferentially spaced wall ports 44.

Between the confronting ends of the coupling 18 and outer sleeve 20, the inner sleeve is provided with a pair of longitudinally spaced annular outstanding shoulders 46 and 48. An O-ring 50 interposed between the coupling 18 and shoulder 46 is partially nested by an annular recess 52 formed in the adjacent end surface of the coupling confronting the shoulder 46.

Obviously a garden hose type resilient washer, not shown, may be interposed between the container neck end and the upwardly facing coupling shoulder 28 if desired.

The end portion of the outer sleeve 20 adjacent the annular shoulder 48 is provided with an annular recess 54 which receives an expansion spring 56 normally biasing the outer sleeve 20 away from the annular shoulder 48 to close the inner sleeve outlet ports 44 as will now be explained.

The periphery of the end portion of the inner sleeve 16 opposite the shoulder 48 is diametrically reduced to form an annular space 57 between the outer periphery and inner periphery of the outer sleeve 20. Similarly the outer periphery of the outer sleeve 20, opposite the discharge ports 44 is removed to form a flexible wall end portion 58 converging toward its downward end for contact with the annular rib 42. The inner peripheral wall surface of the outer sleeve end portion 58 adjacent its end opposite the spring is arcuately recessed as at 60 for cooperative reception in friction gripping relation with the rib arcuate surface of the rib 42 for closing the inner sleeve outlet ports 44.

When the spring 56 biases the outer sleeve toward the closed end 40 of the inner sleeve, the resilience of the material forming the outer sleeve frictionally grips the rib 42 in an liquid tight sealing action until forceably separated therefrom to open the valve 10 as presently explained.

Figure 4:
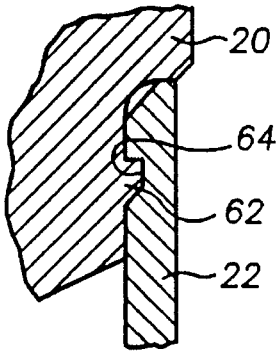
FIG. 4 is a fragmentary vertical cross sectional view, to a further enlarged scale, of the area encompassed by the arrow 4 of FIG. 1.
Figure 9:
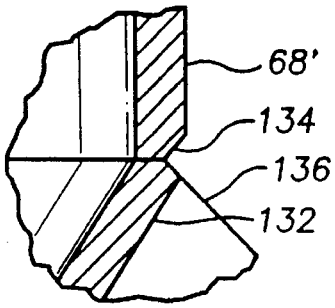

As best shown by FIG. 4, the periphery of the outer sleeve wall adjacent its reduced end portion 58 is diametrically reduced to provide an annular outstanding lug 62 which is cooperatively received by an annular recess 64 formed on the inner periphery of the adjacent end portion of a funnel-like discharge tube 22 for securing the latter to the outer sleeve.

Beyond its upper end, as viewed in the drawings, the wall of the discharge tube 22 converges, as at 66, to form a smaller diameter portion 68 capable of being loosely received by the wall forming an inlet port 70 of a vessel, not shown, receiving fluid (FIG. 2). The tapered surface 66 of the outlet tube 22 is preferrably provided with a plurality of radial outstanding circumferentially spaced vertical disposed edgewise ears 72 preferrably having a thickness on the order of the wall thickness of the outlet tube 22. The purpose of the ears 72 is to abut the adjacent end surface of the wall forming the inlet port 70 of a vessel receiving fluid for opening the valve 10 and releasing air displaced by liquid entering a vessel, as presently explained.

Between its shoulders 46 and 48, the inner tube 16 is provided with a wall opening 74 for receiving an aerator air inlet tube and check valve means 75 for filling the void in the container 14 caused by the release of fluid through its neck 12.

The check valve means comprises an aerator tube 76 having one end portion 78 disposed in the inner sleeve wall opening 74 and its other end portion 80 projecting upwardly into the container 14, as viewed in the drawings, adjacent the inner surface of one wall 82 thereof and terminating at its end opposite the opening 74 in spaced relation with respect to the inner surface of the end wall 84 of the container 14 for admitting atmospheric air into the interior of the container 14 through a check valve 86.

The check valve 86 is formed by a check valve body 88 having a longitudinal series of tube gripping annular shoulders 90 for gripping the inner peripheral wall of the tube end portion 78 when manually forced thereinto.

The outward end of the body 88 is closed by a cap 92 having a valve seat forming central bore 94 and defining an annular flange 96 which abuts the outer surface of the adjacent portions of the inner sleeve shoulders 46 and 48.

The inner wall surface of the check valve body 88 receives a ball valve 100 which seals with the seat formed by the bore 94 when forced outwardly of the tube and is maintained within the check valve body by tabs 102 struck inwardly from the body wall end surface opposite its cap 92.

In operation of the embodiment of the valve 10 as described for FIGS. 1 and 2, the commercially supplied cap, not shown, on the container 14, is removed with the container in an upright position. The valve 10 is connected with the container neck 12 by inserting the air inlet tube 76 into the container through its neck portion and manually tightening the coupling 18 on the container threads 36. The valve outlet ports 44 being closed by the spring biasing the outer sleeve end portion 58 into engagement with the inner sleeve closed end rib 42.

The container may then be inverted to place the discharge tube 68 into the port of a vessel to receive fluid from the container, the ears 72 resting on the end of the wall 70 forming the receiving vessel port. Force manually applied to the container 14 and inner tube 16 overcomes the resistance of the spring 56 and abuts the outer sleeve upward end against the inner sleeve shoulder 48 which opens the inner sleeve outlet ports 44 permitting fluid to flow, by gravity, from the container 14 in the direction of the arrows 73 into the receiving vessel.

When desired portions of the fluid, not shown, has been discharged into the receiving vessel manual pressure is released from the container 14 inner sleeve 16 and they are lifted to allow the resilience of the spring 56 to force the outer sleeve 20 into closing engagement with the inner sleeve rib 42.

Referring also to the remaining figures in which like parts have identical reference numerals and modified parts have prime numerals.

The reference numeral 10' indicates a second embodiment of the push open valve in which the inner sleeve is divided adjacent its annular shoulder 48 to provide a first inner sleeve coupling portion 112 for connection with the container neck 12 and a second inner sleeve fill tube portion 114 respectively connected with respective ends of an elongated flexible tube 115 for dispensing fluid in a hard to reach position for example, the fill tube of most automatic transmissions of automobiles. The modified first inner sleeve end portion 16' is provided with an integral extension sleeve 116 of selected length for receiving one end portion of the flexible tube 115. Similarly, the lower end portion of the second inner sleeve end portion 16" is integrally connected with a second shoulder 120 and a sleeve extension 122 of selected length for similarly receiving the other end portion of the flexible tube 115. Adjacent their respective tube connected ends, the sleeve extensions 116 and 122 are provided with an annular bulge 118, respectively, to maintain the respective end portion of the flexible tube 115 on the respective sleeve extension. The spring 56 similarly abuts the shoulder 120 and adjacent recessed end of the outer sleeve 20 in this embodiment.

The modified funnel-like tube 22' opposite the closed end of the second inner sleeve end portion 16" is axially connected with a funnel-like extension 126 having a stem portion 128 dimensioned to freely enter the fill tube 130 of an automatic transmission. The outwardly flared wall 132 of the funnel extension 126 has its end surface integrally connected in end abutting relation with the fill tube portion 68' in a break-away joint characterized by an annular outwardly open V-shaped groove 134 for easily separating the funnel shape extension 126 from the fill tube stem portion 68" if desired.

The outer surface of the funnel shaped fill tube wall 132 is similarly provided with a plurality of circumferentially spaced outstanding ears 136 forming a stop when abutting the upper end surface of the transmission tube wall 130 and permitting air exhaust from the tube 130 as fluid enters the transmission.

Figure 5:
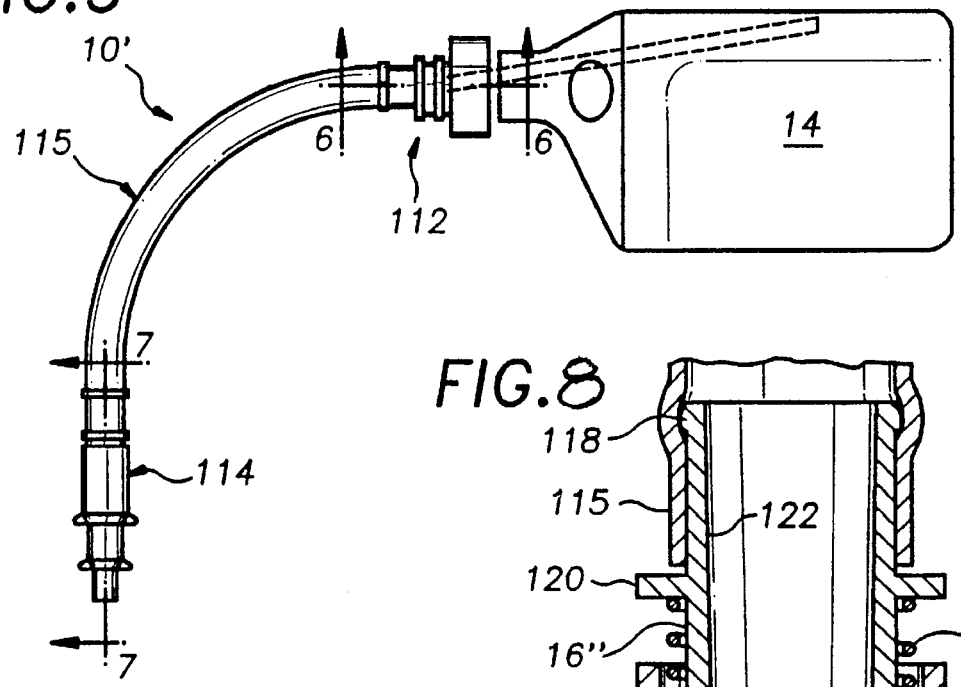
FIG. 5 is a side elevational view to a different scale of a second embodiment of the valve when connected with the container of FIG. 1.
Figure 8:
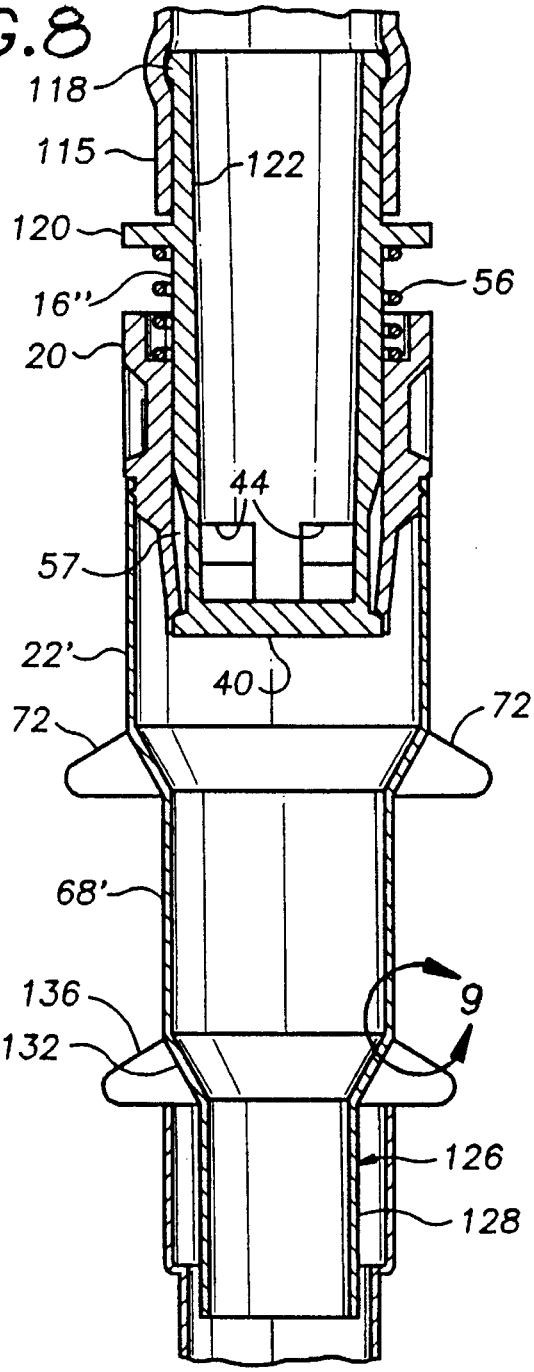
FIG. 8 is a fragmentary vertical cross sectional view similar to FIG. 7 illustrating the valve in open position; and, FIG. 9 is a fragmentary vertical cross sectional view, to an enlarged scale, of the area encompassed by the arrow 9 of FIG. 8.

In operation the coupling attached first inner sleeve end portion of the valve is similarly connected with the threaded neck of the container 14 after inserting the aerating tube 76 into the container 14. The container is preferably held in a substantially horizontal position (FIG. 5) with its wall 82 disposed upwardly for admission of air into the container through the check valve assembly 75. The funnel-like fill tube extension 126 is manually inserted into the transmission fill tube 130 and force manually applied to the end portion of the flexible tube adjacent the shoulder 120 overcomes the resistance of the expansion spring 56 uncovering the second inner sleeve 16" discharge openings 44 for dispensing fluid from the container into the transmission fill tube.

Obviously the invention is susceptible to changes or alterations without defeating its practicability. Therefore, I do not wish to be confined to the preferred embodiment shown in the drawings and described herein.

I claim:

1. A fluid dispensing valve for a container having an externally threaded neck opening, comprising;

an inner sleeve having one closed end and having fluid outlet wall ports adjacent its closed end;

an annular outstanding lip on said closed end forming a stop; coupling means on the other end portion of said inner sleeve for securing it in fluid communicating relation to a container neck opening;

an annular first shoulder surrounding said inner sleeve intermediate its ends;

an outer sleeve longitudinally slidably surrounding said inner sleeve outlet ports;

spring means interposed between said shoulder and the adjacent end of said outer sleeve for normally biasing said outer sleeve against said stop and covering the wall ports; and, funnel-like tube means axially secured at its flared wall end portion to the periphery of said outer sleeve for entering a receiving vessel port at its other end portion and uncovering the outlet ports by moving said outer sleeve relative to said inner sleeve when a spring compressing axial force is applied downwardly to said inner sleeve.

2. The fluid dispensing valve according to claim 1 in which the inner sleeve is provided with a wall opening adjacent said first shoulder opposite the outer sleeve and further including:

an aerator tube having one end portion in the coupling attached end portion of said inner sleeve and projecting at said one end portion outwardly through the inner sleeve wall opening and projecting at its other end portion into the container beyond its neck opening; and, check valve means in the outwardly disposed end portion of said aerator tube for precluding outward passage of fluid.

3. The fluid dispensing valve according to claim 2 and further including:

a plurality of ear means secured to the periphery of said funnel-like tube in outstanding circumferential spaced relation for limiting axial movement into a receiving vessel port.

4. The fluid dispensing valve according to claim 1 and further including:

a second annular shoulder surrounding said inner sleeve and interposed between said first shoulder and the outer sleeve, said inner sleeve being transversely divided between said first and said second shoulders to form an inner sleeve container neck attaching end portion and a fluid outlet inner and outer sleeve end portion; and, an elongated tube axially connected at its respective end portions with said inner sleeve container neck attaching end portion and the outer sleeve of said fluid outlet inner and outer sleeve end portion, respectively.

5. The fluid dispensing valve according to claim 4 in which the inner sleeve is provided with a wall opening adjacent said first shoulder opposite the coupling means and further including:

an aerator tube having one end portion in the coupling attached end portion of said inner sleeve and projecting at said one end portion outwardly through the inner sleeve wall opening and projecting at its other end portion into and beyond the neck opening of a container; and, check valve means in the outwardly disposed end portion of said aerator tube for precluding outward passage of fluid.

6. The fluid dispensing valve according to claim 5 and further including:

a plurality of ear means secured to the periphery of said funnel-like tube in outstanding circumferential spaced relation for limiting axial movement into a receiving vessel port.

7. A fluid dispensing valve for a container having an externally threaded neck opening, comprising:

a first inner sleeve;

a second inner sleeve;

a tube axially interposed between and connected with one end portion of said first inner sleeve and one end portion of said second inner sleeve, respectively;

sleeve coupling means secured to the other end portion of said first inner sleeve for axially attaching said first inner sleeve to a fluid container;

a first annular shoulder surrounding said first inner sleeve between said coupling means and said tube, said second inner sleeve having its other end closed and having fluid outlet wall ports adjacent its closed end;

an annular outstanding lip on said second inner sleeve closed end forming a stop;

a second annular shoulder surrounding said second inner sleeve adjacent said tube;

an outer sleeve longitudinally slidably surrounding said second inner sleeve end portion adjacent said second shoulder opposite said tube;

spring means interposed between said second shoulder and said outer sleeve for normally biasing said outer sleeve against said stop and covering the wall ports; and, funnel-like tube means axially secured at its flared wall end portion to the periphery of said outer sleeve for entering a receiving vessel port at its other end portion and uncovering the outlet ports by moving said outer sleeve relative to said inner sleeve when a spring compressing axial force is applied downwardly to said second inner sleeve end portion.

8. The fluid dispensing valve according to claim 7 in which the inner sleeve is provided with a wall opening adjacent said first shoulder opposite the outer sleeve and further including:

an aerator tube having one end portion in the coupling attached end portion of said first inner sleeve and projecting at said one end portion outwardly through the first inner sleeve wall opening and projecting at its other end portion into and beyond the neck opening of a container; and, check valve means in the outwardly disposed end portion of said aerator tube for precluding outward passage of fluid.

9. The fluid dispensing valve according to claim 8 and further including:

a plurality of ear means secured to the periphery of said funnel-like tube intermediate its ends in outstanding circumferential spaced relation for limiting axial movement of said tube into a receiving vessel port.

* * * * *